US005167585A

United States Patent [19]

Williams

[11] Patent Number: 5,167,585

[45] Date of Patent: Dec. 1, 1992

[54] BLIND RIVETING ASSEMBLY

[75] Inventor: Barry T. Williams, Bromsgrove, United Kingdom

[73] Assignee: Emhart Inc., Newark, Del.

[21] Appl. No.: 724,525

[22] Filed: Jun. 28, 1991

[30] Foreign Application Priority Data

Jul. 17, 1990 [GB] United Kingdom ..... 9015648

[51] Int. Cl.[5] ..... B21K 1/60

[52] U.S. Cl. ..... 470/29; 411/70

[58] Field of Search ..... 411/70; 10/27 PH, 46; 72/187, 194, 198; 470/29

[56] References Cited

U.S. PATENT DOCUMENTS

| | | | |
|---|---|---|---|
| 333,323 | 12/1885 | Morgan | 72/187 |
| 1,654,077 | 12/1927 | Griffiths | 72/187 |
| 2,821,727 | 2/1958 | Corckran | 10/46 |
| 3,213,898 | 10/1965 | Le Grady et al. | 140/112 |
| 3,696,702 | 10/1972 | Krause | 411/70 |
| 3,810,376 | 5/1974 | Elle | 72/194 |

*Primary Examiner*—Lowell A. Larson

*Attorney, Agent, or Firm*—Spencer T. Smith

[57] ABSTRACT

A blind rivet assembly comprising a flanged rivet body and a mandrel having a stem provided with extension means wherein wire fed to mandrel-forming means is first subjected to at least one operation to form a series of indentations on the surface of the feed wire. This may be carried out by a plurality of pairs of indenting rolls arranged symmetrically around the feed wire.

6 Claims, 1 Drawing Sheet

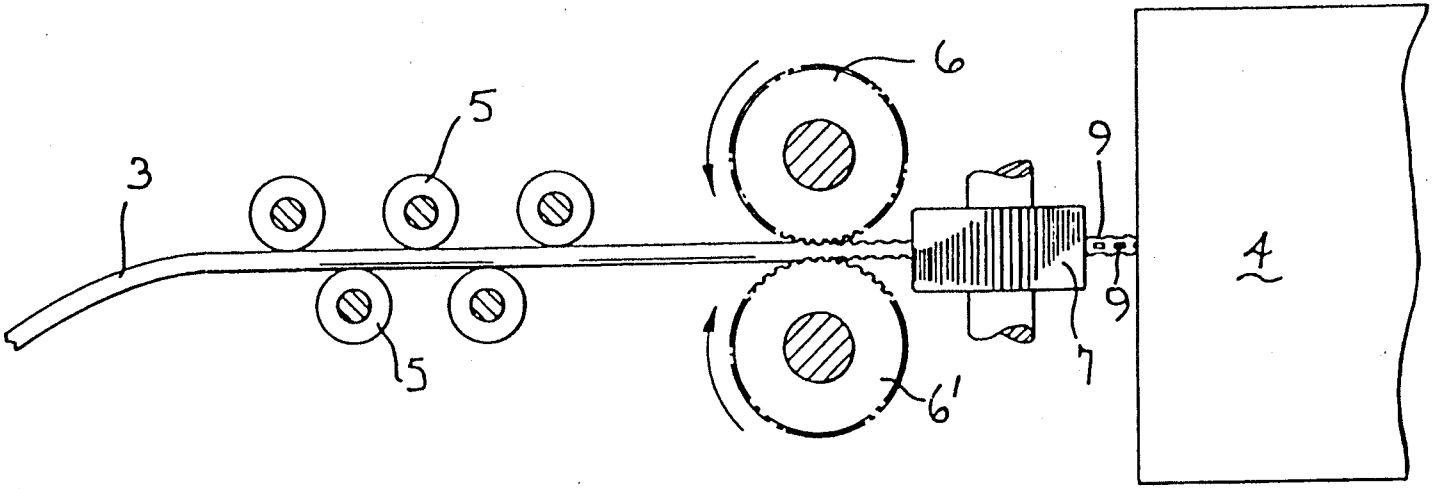
FIG. 1
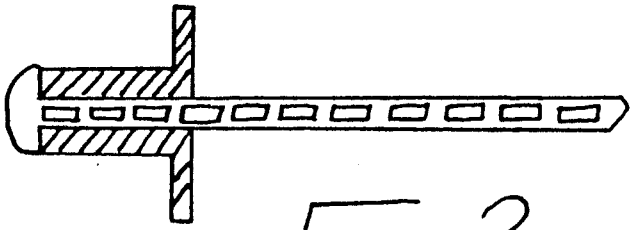
FIG. 3
FIG. 2
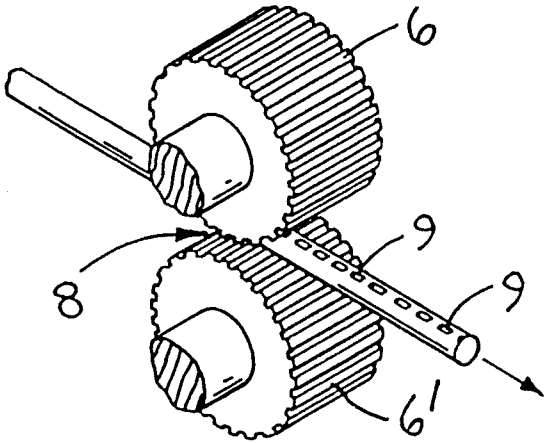

BLIND RIVETING ASSEMBLY

BACKGROUND OF THE INVENTION

The present invention relates to an improved blind riveting assembly and its manufacture. The expression "blind-riveting assembly" is used herein to denote an assembly of a type comprising a flanged rivet body and a mandrel, the mandrel having a stem with expansion means (which may be an integral head or may comprise an integral head or swelling with an expansion sleeve on or adjacent to it) at one end, part of the stem lying within a tubular portion of the rivet body and part, remote from the expansion means, projecting from a head flange at one end of the rivet body, the expansion means of the mandrel being too large to pass through the tubular portion of the rivet body without deforming it, and the arrangement being such that said expansion means and the tubular portion of the rivet body may be inserted through a hole in a workpiece from one side in such a manner that the head flange of the rivet body abuts the workpiece at said one side and part of the tubular portion of the rivet body adjacent said expansion means of the mandrel projects from the other side, and the rivet is set by pulling the mandrel stem at said one side of the workpiece while holding the head flange of the rivet body against the workpiece, thereby causing the expansion means of the mandrel to effect radial expansion of the tubular portion of the rivet body at the other side of the workpiece. The mandrel stem is gripped by a setting tool and is detached at a predetermined breaking point after exceeding a certain pulling force.

The most common variety of blind-riveting assembly is one in which the expansion means is a head of the mandrel integral with the stem, the mandrel head being exposed adjacent to the tail end of the rivet body. Such an assembly is usually made by a method comprising the separate manufacture of mandrel and rivet and their subsequent assembly together in an assembly machine.

Mandrels for blind-rivet assemblies are usually formed from wire fed continuously into a mandrel-forming machine and cut into lengths which are fed into assembly machines where they are assembled with the rivet bodies.

In order to ensure an optimum grip of the setting tool on the mandrel stem, the mandrel stem may be given a modified profile, such as the provision of ridges, grooves and the like which reduce any tendency of the setting tool to slide on the mandrel. Such profile modifications of the mandrel stem can be carried out on the blind-rivet assemblies or on the mandrels prior to assembly.

It is an object of the present invention to provide a blind rivet assembly having a profiled mandrel stem which is simpler to produce.

SUMMARY OF THE INVENTION

According to the present invention, a process for the production of a blind rivet assembly comprising a flanged rivet body and a mandrel having a stem provided with expansion means is characterised in that wire fed into mandrel-forming means is first subjected to at least one operation whereby a series of indentations is formed on the surface of the feed wire.

Thus, when the subsequently formed mandrel is combined with the flanged rivet head, the mandrel is provided with an indented profile without the need of further forming operations.

The indentations in the feed wire may be formed by apparatus associated with the feed to the mandrel-forming means or alternatively may be carried out by the wire manufacturer so that pre-indented wire can then be fed to conventional, un-modified, mandrel-forming means.

The process of the present invention ensures that the mandrels can be give the required profile without slowing down production of blind rivet assemblies and also ensures that every rivet assembly has the required number of indentations.

The indenting of the wire fed to the mandrel-forming means according to the present invention may be carried out by a set of at least one pair of indented rolls through which the wire is fed or a plurality of sets of rolls may be used arranged so that the longitudinal axes of each of the pairs of rolls are at different angles normal to the longitudinal axis of the wire passing through the nip of the rolls. It is obviously preferred to form the indentations over as much of the mandrel surface as possible and thus larger diameter wire may be indented by sets of three, four or more pairs of rolls arranged usually symmetrically, around the wire fed to the mandrel forming means. The pairs of indenting rolls may act to provide a positive feed of the wire but alternatively a tension may be applied to the wire to draw it through the mandrel-forming means and hence, of course, through the pair(s) of indenting rolls.

BRIEF DESCRIPTION OF THE DRAWINGS

A preferred embodiment of the invention will now be described by way of example with reference to the accompanying drawing in which:

FIG. 1 schematically shows the feed of wire to mandrel forming means of a blind rivet manufacturing line, FIG. 2 illustrates, on a larger scale, one pair of the indenting rolls illustrated in FIG. 1, and FIG. 3 shows blind rivet with the rivet body in cross section made with the wire shown in FIGS. 1 and 2.

DETAILED DESCRIPTION OF THE DRAWINGS

The wire 3 to be formed into mandrels in mandrel forming means 4 is fed from a coil (not shown) through a series of rolls 5 in order to straighten the wire and then passes through a succession of pairs of indenting rolls 6,6', 7,7'. . . .

Each of the indenting rolls has an indented surface whereby the wire passing through the nip 8 of rolls 6,6', 7,7' is marked with a continuous series of indentations 9 along opposite sides of wire 3. The drawing shows two pairs of rolls 6,6' and 7,7' arranged with their axes normal to each other and to the longitudinal axis of wire 3. However, further numbers of pairs of indenting rolls may be arranged preferably symmetrically round wire 3 so that its surface is adequately profiled before it is fed into mandrel forming means 4.

Rivet assemblies including mandrels produced from wire treated in accordance with the present invention require no further forming to provide a profile surface on the mandrels.

I claim:

1. A process for the production of a blind rivet assembly comprising a flanged rivet body and a mandrel having a stem provided with a head at one end comprising defining a series of gripping facilitating indentations on the surface of the feed wire throughout the entire length of the wire, forming the mandrel from a length of said wire after said indentations have been defined on the wire, and assembling the blind rivet with said gripping facilitating indentations being located on the gripping end of the stem and along its entire length from the head and along the stem as it passes through the flanged rivet body.

2. A process according to claim 1 wherein the indentation defining operation is carried out by a set of at least one pair of indented rolls through which the wire is fed.

3. A process according to claim 2 wherein the set of indented rolls comprises two or more pairs of rolls.

4. A process according to claim 2 wherein a plurality of sets of rolls is used, arranged so that the longitudinal axes of each of the pair of rolls are at different angles normal to the longitudinal axis of the wire passing through the nip of the rolls.

5. A process according to claim 2 wherein a pair of indented rolls act to provide a feed of the wire.

6. A process according to claim 2 further comprising tensioning the wire to drawn it through the pair of indenting rolls.

* * * * *